US008021117B2

(12) United States Patent
Kubota

(10) Patent No.: US 8,021,117 B2
(45) Date of Patent: Sep. 20, 2011

(54) IMPELLER FOR SUPERCHARGER AND METHOD OF MANUFACTURING THE SAME

(75) Inventor: Yasuhiro Kubota, Matsue (JP)

(73) Assignees: Hitachi Metals Precision, Ltd., Tokyo (JP); Hitachi Metals, Ltd., Tokyo (JP)

( * ) Notice: Subject to any disclaimer, the term of this patent is extended or adjusted under 35 U.S.C. 154(b) by 1053 days.

(21) Appl. No.: 11/574,661

(22) PCT Filed: Feb. 21, 2006

(86) PCT No.: PCT/JP2006/003062

§ 371 (c)(1),
(2), (4) Date: Aug. 1, 2007

(87) PCT Pub. No.: WO2006/090701

PCT Pub. Date: Aug. 31, 2006

(65) Prior Publication Data

US 2009/0252609 A1 Oct. 8, 2009

(30) Foreign Application Priority Data

Feb. 22, 2005 (JP) ..... 2005-045157

(51) Int. Cl.

| | |
|---|---|
| ***F04D 29/30*** | (2006.01) |
| ***B22C 9/06*** | (2006.01) |
| ***B22D 17/00*** | (2006.01) |
| ***B22D 17/22*** | (2006.01) |

(52) U.S. Cl. ..... 416/175; 416/203; 29/869.4; 29/527.5

(58) Field of Classification Search ..... 416/186 R, 416/203, 175, 234, 183; 29/889, 889.4, 527.5
See application file for complete search history.

(56) References Cited

U.S. PATENT DOCUMENTS

| | | | | |
|---|---|---|---|---|
| 4,284,124 | A * | 8/1981 | Komatsu et al. | 164/314 |
| 4,975,041 | A * | 12/1990 | Fries et al. | 425/547 |
| 6,904,949 | B2 * | 6/2005 | Decker et al. | 164/35 |
| 2002/0187060 | A1 | 12/2002 | Decker et al. | |
| 2004/0255917 | A1 * | 12/2004 | Mokry | 123/559.1 |

FOREIGN PATENT DOCUMENTS

| | | | |
|---|---|---|---|
| JP | 02187243 | A | 7/1990 |
| JP | 2000213493 | A | 8/2000 |
| JP | 2002113749 | A | 4/2002 |
| JP | 200394148 | A | 4/2003 |
| JP | 2004-291032 | | 10/2004 |
| JP | 2005030382 | A | 3/2005 |
| WO | WO 2005116454 | A1 * | 12/2005 |

* cited by examiner

*Primary Examiner* — Edward Look
*Assistant Examiner* — Jesse Prager
(74) *Attorney, Agent, or Firm* — Sughrue Mion, PLLC

(57) ABSTRACT

An impeller for a supercharger cast in molds to provide excellent aerodynamic performance by eliminating parting-line corresponding parts from a hub surface and vane surfaces in each space formed of a pair of long vanes adjacent to each other an a method of manufacturing the impeller. The method comprises a step for casting the impeller in the molds. Molten metal is poured in spaces formed by radially arranging, toward a center axis, the plurality of slide molds each having a short vane-shaped bottomed groove part and a shape for the space between the pair of long vanes adjacent to each other to mold the impeller. Then, the slide molds are moved in the radial direction of the center axis while rotating for mold-releasing. Thus, the impeller for the supercharger having no parting-line corresponding parts on both the hub surface and the vane surfaces in each space formed of the pair of long vanes adjacent to each other can be provided.

13 Claims, 4 Drawing Sheets

IMPELLER FOR SUPERCHARGER AND METHOD OF MANUFACTURING THE SAME

CROSS-REFERENCE TO RELATED APPLICATIONS

This is a National stage Application under 35 U.S.C. §371 of PCT/JP2006/303062 with an International Filing Date of Feb. 21, 2006, and claims priority from Japanese Patent Application No. JP 2005-045157 filed Feb. 22, 2005; the entire disclosure of which are incorporated by reference.

FIELD OF THE INVENTION

The present invention relates to an impeller for a supercharger, which makes use of exhaust gas from an internal combustion engine to feed a compressed air, and a method of manufacturing the same.

DESCRIPTION OF THE RELATED ART

In a supercharger incorporated in an engine of an automobile or the like, an impeller at an exhaust side is caused to rotate with utilization of exhaust gas from an internal combustion engine thereby rotating a impeller coaxially at an intake side to feed a compressed air to the engine to increase an engine output. Since the exhaust side impeller is exposed to the high temperature exhaust gas discharged from the engine, in general it has been made from a heat resistant Ni-based super alloy, and it is not so much complex in shape, so that it is manufactured by the lost wax casting process. On the other hand, since the intake side impeller is not exposed to a high temperature, usually it is made from an aluminum alloy. In order to achieve an increase in compressibility of compressed air, the intake side impeller has often a complex blade configuration, in which two types of full and splitter blades having different shapes are arranged alternately adjacent to each other in plural.

Recently, higher speed rotation is requested of an intake side impeller for an increase in combustion efficiency and application of titanium alloys having a higher strength than that of aluminum alloys and disclosed in JP-A-2003-94148 (Patent Publication 1) has been examined. Also, for conventional impellers made of an aluminum alloy, a blade configuration of an impeller and an improvement in dimensional accuracy have been examined with a view to an improvement in aerodynamic performance. Further, application of magnesium alloys having higher strength than aluminum alloys and smaller weight than titanium alloys has been examined.

In case of applying a lost wax casting process to manufacture of an intake side impeller, it is necessary to fabricate an sacrificial pattern having the same form as a final product of an impeller as a die casting method. For example, Patent Publication 1 proposes to redesign a blade configuration so that a die insert (slide die) can be taken out of a blade part of a sacrificial pattern, and Patent Publication 1 proposes an impeller manufactured by a lost wax casting process, which is referred to as investment casting. Such proposal is excellent in enabling mass production of impellers made of a titanium alloy at a relatively low cost.

In manufacture of a casting made of aluminum or magnesium alloys, a die casting method is frequently used, according to which casting defects are hard to generate, a favorable dimensional accuracy is obtained, and a casting having a smooth casting surface can be mass-produced in high cycle. In the die casting method, a molten metal or semi-molten metal is filled directly into dies to form and shape a casting.

According to a pressure at which a molten metal is fed into dies, for example, the die casting method is classified into a low-pressure casting method, a gravity casting method, and a pressurization casting method. Also, according to a feeding way for a molten metal, the die casting method is classified into an absorption casting method, a decompression casting method and an injection casting method. In particular, the pressurization casting method, in which a pressurized molten metal is filled into dies, is generally referred to call die-casting and frequently used since it is favorable in run quality and hard to generate nonuniformity in cooling. Also, the injection casting method, in which a molten metal in a semi-molten state is fed to dies, is called a thixomold casting method, suffers less solidification defect such as shrinkage, crack of a casting, and presents a high, dimensional accuracy since a semi-molten metal being lower in molten metal temperature than a conventional die casting method is injection-molded into dies.

With regard to an impeller produced by casting in dies includes, JP-A-2000-213493 (Patent Publication 2) discloses one example thereof which is produced by jointing separately formed blade parts to a hub part, and which the impeller is simple in shape without undercuts at blade parts. Also, for example, JP-A-2004-291032 (Patent Publication 3) discloses a molding machine for molding of various molded products such as ornaments made of an aluminum alloy or a magnesium alloy, various containers, housings for precision parts, camera, computer, etc., automotive parts, business machine parts, etc. but a applied shape is limited to a simple shape, which facilitates release of a housing from dies.

As set forth above, the intake side impeller has often a complex blade configuration in which two types of full and splitter blades are arranged. Especially, in the case where such an impeller has no undercut at blade parts, it has been produced by a plaster mold process instead of the conventional die casting method, according to which plaster mold process, a casting mold is fabricated by pouring plaster in a flexible rubber pattern. The rubber pattern is fabricated by forming a master model of an impeller, a silicon rubber into the master model to form a rubber mold, and further pouring a silicon rubber into the rubber mold, and so it is possible to reproduce a complex shape, but involves a problem that its dimensional accuracy is inferior to the die casting method.

SUMMARY OF THE INVENTION

Figure 1:
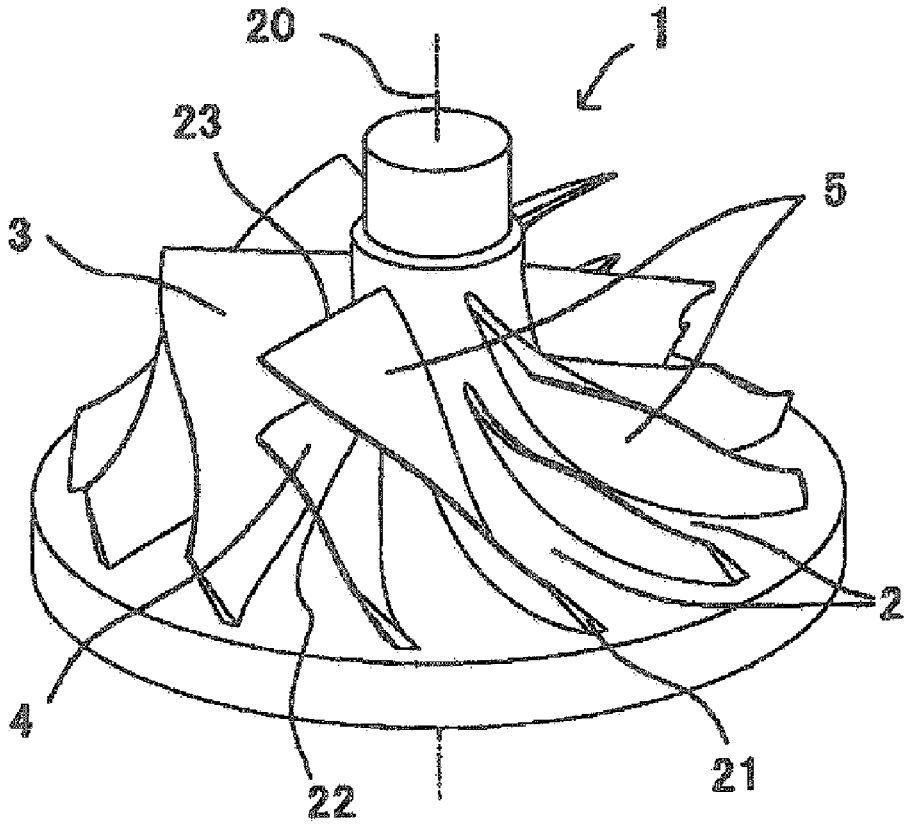
FIG. 1 is a schematic view showing an example of an impeller for a supercharger.

The present inventors considered to use a die casting method having advantages of excellent dimensional accuracy than a plaster mold process, forming of a smooth and fine casting surface, reducing machining, and to form an impeller by directly pouring a molten metal into a forming die for a sacrificial pattern while paying attention to a fact that a sacrificial pattern used in a lost wax casting method has substantially the same shape as that of the impeller. In the case of an impeller, in which undercuts are provided radially of a center axle in a space surrounded by a blade, in which full and splitter blades are alternately formed adjacent to each other, however, the die opening is difficult after casting. Also, even in the case of using a forming die for an sacrificial pattern used in the method of, for example, Patent Publication 1, it leads to redesigning a blade configuration so that a slide die adapted for two-dimensional movement can be taken out of an impeller as cast, so that the blade configuration is extremely limited and it becomes difficult to manufacture an impeller having a high aerodynamic performance and being complex in shape.

An object of the invention is to solve the problems and to provide an impeller for a supercharger, in which a high aerodynamic performance can be expected, and a method of manufacturing the same.

The present inventors tried to form an impeller having a shape, in which an undercut is formed radially, by casting a molten metal directly in a die and have examined application of a slide die having a specific structure in a mold for casting and optimization of a release operation thereof whereby attaining the invention.

That is, the manufacturing method according to the invention is of manufacturing an impeller for a supercharger by die casting, which impeller comprises a disk-shaped hub extending radially of a center axle, a plurality of blades extending from the hub and consisting of full blades and splitter blades arranged alternately and in adjacent relationship, each of which blades has an aerodynamically curved surface, spaces defined by the blades forming undercuts extending radially of the center axle, wherein the process of die casting comprises the step of:

casting a molten metal into a space, which is defined by arranging a plurality of slide dies, each of which has a bottomed groove portion in the form of a splitter blade and a spatial configuration between a pair of adjacent full blades, radially toward the center axle, to form the impeller, and subsequently moving and releasing the slide dies radially of the center axle while rotating those slide dies.

In the invention, a die device used in the process of die casting comprises a moving die capable of opening and closing movements in a direction along a center axle, a stationary die, a plurality of slide dies capable of moving radially of the center axle, and a slide support provided on the respective slide die to support the same, and the respective each of the slide supports is driven to enable interlocking of the plurality of slide dies.

Also, the slide die can be formed by integrally bonding a plurality of cores (that is, a plurality of components) with one another slide die. Also, a motional line, along which each of the slide dies is released from a cast impeller, preferably consisting of a motional line at XY coordinates on a two-dimensional plane, to which the center axle of the impeller is perpendicular, and a motional line including a rotational component about the motional line at the XY coordinates.

According to the above manufacturing method, it is possible to form parting-line corresponding parts only on a trailing edge face, a fillet face, and a leading edge face, which form an outer peripheral of a full blade, in a space surrounded by blades. Thereby, it is possible to obtain an impeller for a supercharger, which is new and excellent in aerodynamic performance, and in which any parting-line corresponding part is not present both on a hub surface and blade surfaces in a space surrounded by blades.

That is, an impeller for a supercharger, according to the invention, which is of a die casting and has a center axle, and which comprises a disk-shaped hub extending radially of the center axle, a plurality of blades extending from the hub and consisting of full blades and splitter blades arranged alternately and in adjacent relationship, each of which blades has an aerodynamically curved surface, spaces defined by the blades forming undercuts extending radially of the center axle, wherein respective spaces defined by pairs of the adjacent full blades comprise parting-line corresponding parts only on a trailing edge face, a fillet face, and a leading edge face, which form an outer peripheral of the full blade.

In the invention, an aluminum alloy is cast in dies to provide an impeller for a supercharger, made of an aluminum alloy. In addition, other general casting materials such as magnesium alloys, etc. than aluminum alloys can be also used in the invention.

The impeller according to the invention can be used as an impeller at an intake side of a supercharger. In this case, lightweight casting materials such as aluminum alloys and magnesium alloys are especially preferred. Also, magnesium alloys are especially suitable to application of the invention in terms of being more light and larger in specific strength than aluminum alloys.

According to the invention, it is possible to provide an impeller for a supercharger, which is excellent in aerodynamic performance and in which any parting-line corresponding part is not present on a hub surface and blade surfaces in a space surrounded by blades, which is very industrially effective.

DETAILED DESCRIPTION OF THE INVENTION

As described above, an important feature of the invention resides in that application of a slide die, which has a specified construction, to dies for casting of a molten metal and a release operation of the dies are optimized by trying to apply a die casting method, in which a molten metal is filled directly in dies to provide for forming to manufacture a configuration having an undercut formed radially of a center axle.

Specifically, the die casting process comprises:

casting a molten metal into a space, which is defined by arranging a plurality of slide dies, each of which has a bottomed groove portion in the form of a splitter blade and a spatial configuration between a pair of adjacent full blades, radially toward the center axle, to form the impeller, and subsequently moving and releasing the slide dies radially of the center axle while rotating those slide dies.

A slide die, which constitutes one of important features of the invention, comprises a bottomed groove portion in the form of a splitter blade and a spatial configuration between a pair of adjacent full blades, and a space between full blades, which includes a splitter blade, that is, a space corresponding to two full blades in simple representation can be formed by a single slide die. That is, a bottomed groove portion in the form of a splitter blade defines a cavity, in which a splitter blade is formed, and a space defined by arranging a plurality of slide dies radially toward a center axle defines a cavity to determine shapes of full blades and a center axle. Thereby, it is possible to form a cavity having substantially the same configuration as that of the impeller for a supercharger.

In this manner, a single slide die defines a space corresponding to two full blades whereby the dies can be made simple and parting-line corresponding parts can be provided only on a trailing edge face, a fillet face, and a leading edge face, which form an outer peripheral of a full blade. Thereby, no parting-line is present in the space and no parting-line corresponding part is present on a hub surface and blade surfaces in a space surrounded by blades, in a cast impeller thus obtained.

In the invention, while a molten metal is cast into a slide die arranged in this manner to provide for forming a configuration, in which an undercut is formed radially, is aimed at, so that even when it is tried to move and release a slide die on a two-dimensional space defined radially of a center axle, the cast impeller cannot be released.

Hereupon, according to the invention, the slide die is moved and released radially of a center axle while being rotated. That is, a motional line, in which the slide die is released from a cast impeller, comprises a rotational component about the motional line moving at the XY coordinates in addition to a motional line at XY coordinates on a two-dimensional plane, to which the center axle of the impeller is perpendicular and which extends radially, whereby even a configuration, in which an undercut is formed radially, can be released. Also, further movement of the slide die in a Z direction being a direction toward the center axle may be added depending upon a blade configuration.

The impeller for a supercharger, obtained by the manufacturing method described above, makes an aerodynamically excellent impeller for a supercharger since no parting-line corresponding part is present both on a hub surface and blade surfaces.

Figure 2:
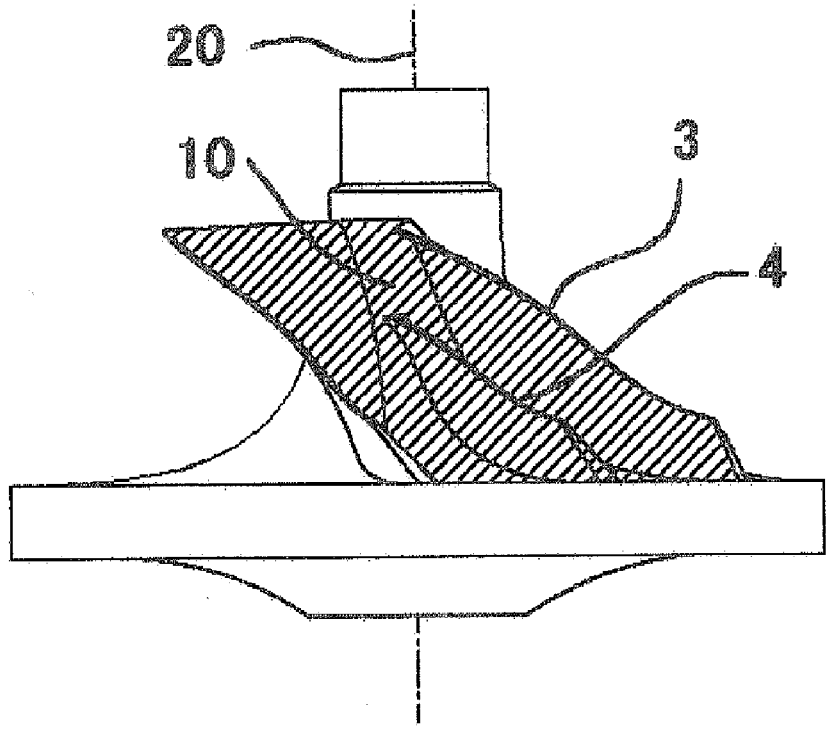
FIG. 2 is a simplified view showing an example of a blade.

Subsequently, a specific example of an impeller for a supercharger is cited and described with reference to the drawings. First, a shape of an impeller for a supercharger is described by way of example. FIG. 1 is a schematic view showing an impeller 1 for a supercharger, including blades formed with full blades and splitter blades, which are used in a supercharger for an internal combustion engine and formed alternately adjacent to each other, and FIG. 2 is a simplified view showing blades of the impeller 1 (only two full blades and one splitter blade are shown for the sake of clarity). A plurality of full blades 3 and a plurality of splitter blades 4, respectively, are protrusively and radially provided on a hub surface 2 extending radially of a center axle 20, the full blades 3 and the splitter blades 4, respectively, having complicate, aerodynamically curved blade surfaces 5 on both sides.

In FIG. 1, the blade surfaces 5 comprises a curved surface portion not including a trailing edge face 21 and a fillet face 22, which correspond to radially outer peripheral surfaces of the full blade 3 and the splitter blade 4, and a leading edge face 23 corresponding to a topmost portion of the respective full blades 3 and the respective splitter blades 4. Also, the hub surface 2 and the blade surface 5 of a space surrounded by blades composed of the full blades 3 and the splitter blade 4 correspond to a space 10 in a hatched area in FIG. 2.

In addition, the blade surface referred to in the invention means a curved surface not including the trailing edge surface 21 and the fillet surface 22, which define outer peripheral sides of the full blade 3, and the leading edge surface 23, which defines a topmost portion of the full blade, for example, in the impeller 1 for the supercharger shown in FIG. 1.

Also, a parting-line referred to in the invention means a difference in level formed on parting faces of a die device and a linear trace generated by insetting of a molten metal into a parted section of the die device.

Also, a slide die applied in the invention and having a bottomed groove in the form of a splitter blade and a spatial configuration between a pair of adjacent full blades suffices to enable moving integrally when being released from an impeller thus cast. Also, while the slide die may be fabricated integrally, it may be provided by fabricating a plurality of cores and then bonding them by means of bolting, brazing, etc. to be made integral. For example, with a slide die 8 shown in FIG. 5, two cores 25, 26 are bonded together at a bonded surface 27 to be made integral. This is because only groove working frequently has difficulty in obtaining a cavity configuration of a splitter blade, which is thin-walled and has a curved surface, as a bottomed groove and split makes it easy to manufacture a slide die.

Figure 7:
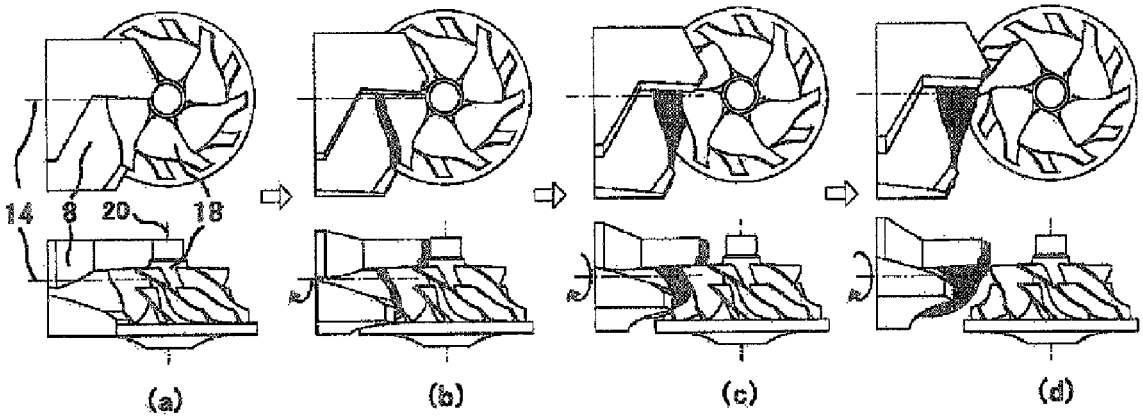
FIG. 7 is a schematic view showing an example of a release operation of a slide die.

Casting, in which a molten metal is cast directly in dies to provide for molding, is applied to manufacture an impeller 1 for a supercharger, shown in FIG. 1, in the following processes. First, a molten metal for casting is prepared in the dies, then the molten metal is supplied to a casting machine, the molten metal is cast in the dies to provide for molding, the dies are then moved and opened as shown in FIG. 7, and an impeller being a molding 18 thus cast and molded is released. A die releasing process for the cast impeller is most important in a manufacturing method in the invention.

Figure 3:
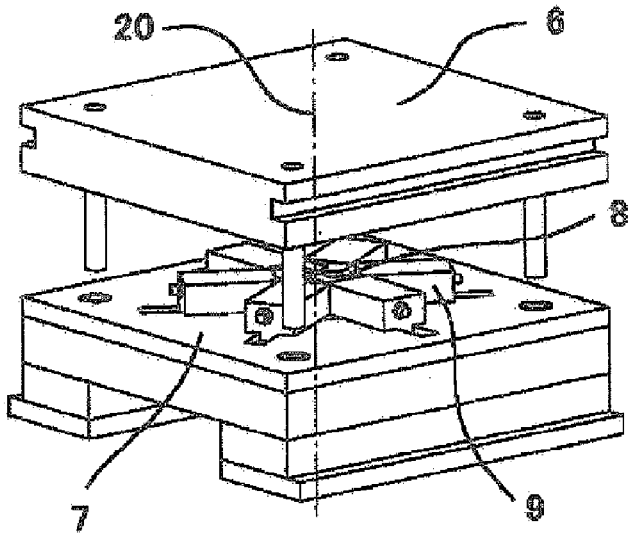
FIG. 3 is a general view showing an example of a die device.

FIG. 3 shows an example of a die device applied to the invention. Dies include a moving die 6 capable of opening and closing in a direction along a axle 20 of an impeller, a stationary die 7, a plurality of slide dies 8 capable of moving radially of the axle 20 of the impeller, and a plurality of slide supports 9, which support the slide dies.

Figure 4:
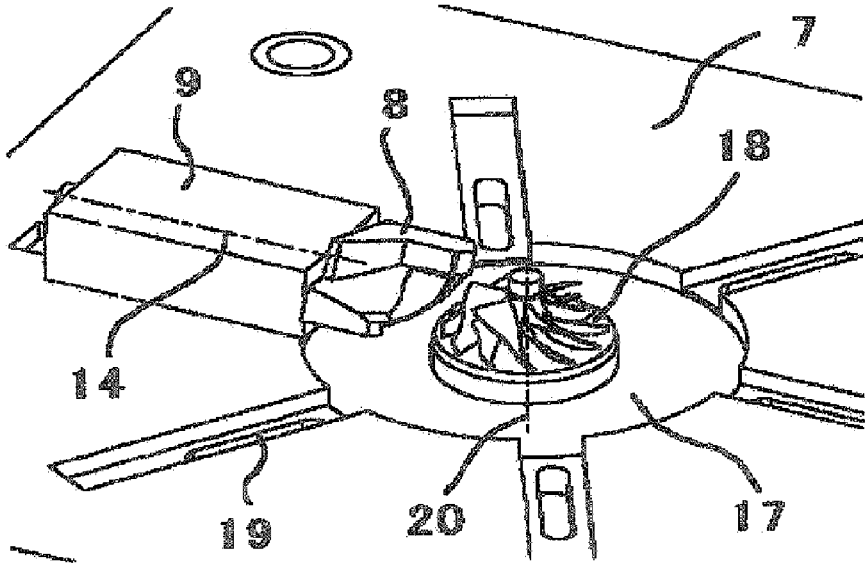
FIG. 4 is a view as viewed along an arrow and showing an example of a stationary die.
Figure 5:
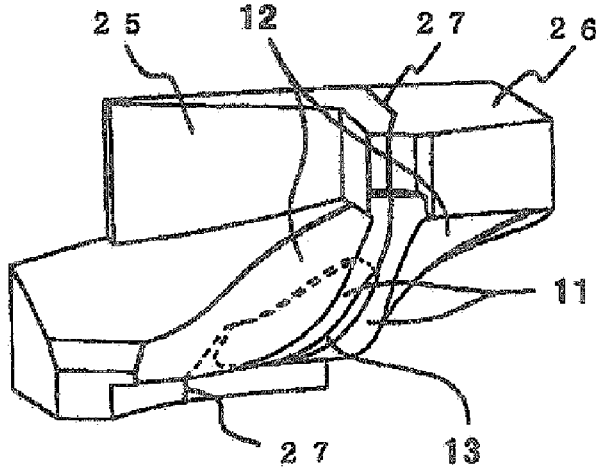
FIG. 5 is a schematic view showing an example of a slide die.

Also, FIG. 4 is a view as viewed along an arrow and showing an essential part of the stationary die 7 (only respective ones of the slide die 8 and the slide support 9 are shown for the sake of clarity), and FIG. 5 is a schematic view showing the slide die 8. The single slide die 8 comprises parts including a hub cavity defining portion 11, a blade cavity defining portion 12, and a bottomed groove portion 13 (shown by broken lines). The hub cavity defining portion 11 defines a hub surface 2 in a space, which contains a single splitter blade and is arranged between a pair of adjacent full blades. The blade cavity defining portion 12 defines two opposed blade surfaces 5 of a pair of adjacent full blades, the trailing edge face 21, which forms a parting-line in a space surrounded by the blades, the fillet face 22, and the leading edge face 23. The bottomed groove portion 13 defines a splitter blade. That is, the single slide die 8 defines a configuration corresponding to the space 10 in the hatched area in FIG. 2.

Figure 6:
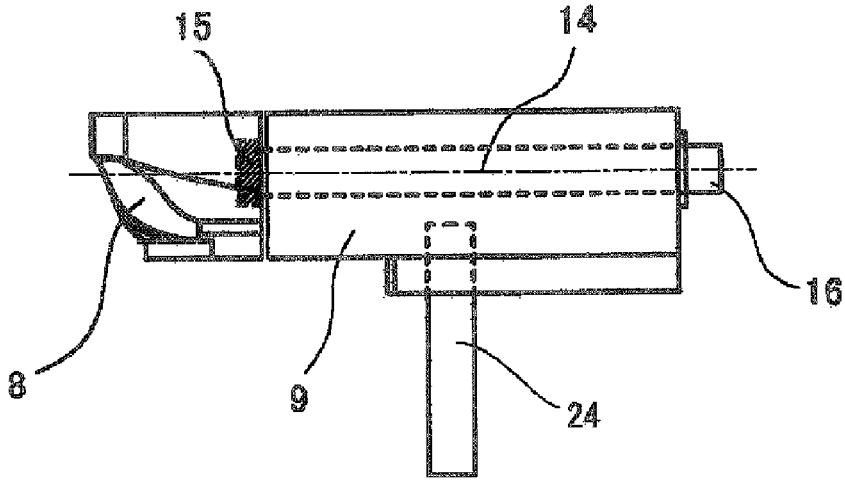
FIG. 6 is a side view showing an example of a joined construction of a slide die and a slide support.

Also, FIG. 6 is a side view showing a joined construction of the slide die 8 and the slide support 9. The slide die 8 is mounted to a stationary pin 16 fixed to the slide support 9 through a bearing 15 mounted at a tip end of the stationary pin 16 for rotation about a rotational axis 14, and is connected to the slide support 9.

With such construction, the slide die 8 is made readily rotatable about the rotational axis 14 with less resistance. Also, as shown in FIG. 4, a ring-shaped or disk-shaped support plate 17 is placed on a bottom surface of the slide die 8 in an area, in which the slide dies 8 are radially movable, and the slide dies 8 are supported by the support plate 17. The support plate 17 is made movable in a direction along the center axle 20 of the impeller. A construction is provided, in which when the moving die 6 and the stationary die 7 are opened, the support plate 17 is moved toward a side, on which it separates from the slide die 8, to make the slide die 8 rotatable, and at this time the slide die 8 is supported only by the slide support 9. Also, at the time of the dies closing, the support plate 17 is returned to its original position to provide a structure in which the rotation of the slide die 8 is restrained.

In the invention, it is important to determine an rotational axis of a slide die. As specific measures, a three-dimensional model, in which CAD/CAM is used, can be used to beforehand retrieve a radial undercut in the space 10 shown in FIG. 2. Also, as further measures, a pattern for retrieval is obtained by first fabricating a partial pattern including a pair of adjacent full blades with a single splitter blade there between and pouring a resin or the like into the partial pattern. Retrieval can also be made by a trial, in which the pattern for retrieval is actually taken out of the partial pattern. With the measures described above, the rotational axis 14, which makes a motional line of the slide die 8 needed for die release from an impeller, is determined. In addition, while it is preferable to retrieve a direction of complete undercut free from contact with an impeller, a space of several tens of microns to several hundreds of microns is actually present between the slide die and a molding 18 since the molding 18 cast during cooling after casting contracts somewhat. Also, the molding 18 itself is in some cases deformable somewhat, so that die release is made possible without influences on the dimensional accuracy even when a motional line of the slide die 8 interferes to some extent with an impeller at the stage of CAD/CAM analysis.

In the invention, it is not necessarily required that the rotational axis 14 described above be perpendicular to the center axle 20 of an impeller depending upon an orientation of an undercut and intersect the center axle 20 of an impeller. For example, it does not matter whether the slide die 8 is withdrawn and moved at an angle of several degrees to the center axle 20 of an impeller.

The slide dies 8 corresponding in number to the spaces 10 on an impeller are arranged annularly as shown in FIG. 3 and the respective slide dies 8, the moving die 6, and the stationary die 7 are closed and brought into close contact together to define a cavity corresponding to a configuration of the impeller 1. A molten metal in a molten or semi-molten state is filled and cast into the cavity by the use of a casting machine such as injection molding casting machine, etc.

Subsequently, an explanation will be given to a specific operation when the slide dies 8 are withdrawn and moved radially from a molding 18 as cast and formed at the time of die release. After casting and forming, the moving die 6 is separated from the stationary die 7 as shown in FIG. 3 and then moved to be opened. Subsequently, the support plate 17 is moved away from the slide dies 8 to have the slide dies 8 supported only by the slide supports 9 to make the slide dies 8 rotatable. As shown in FIG. 4, the slide supports 9 are taken out radially of the center axle 20 along a plurality of grooves 19 formed radially on an upper surface of the stationary die 7. At this time, guide pins 24 can also be provided on bottoms of the slide supports 9 to guide the slide supports 9.

Since the slide die 8 is connected through the bearing 15 mounted on the rotational axis 14 to the slide support 9 by the stationary pin 16 as shown in FIG. 6, it is naturally rotated about the rotational axis 14 along a surface configuration of full blades and a splitter blade of the impeller with less resistance to be released. In addition, the bearing 15 includes inner and outer rings, the inner ring being fixed to the stationary pin 16 and the outer ring being fixed to the slide die 8.

FIG. 7 shows such specific, rotating operation. In addition, that portion of the slide die 8, which defines a cavity corresponding to the space 10 shown in FIG. 2, is hatched in FIG. 7 for the sake of convenience. It is intended for describing a release operation of the slide die 8. FIGS. 7(*a*) to 7(*d*) show a state, in which the slide die 8 is being released from a molding 18. As being released, the slide die 8 rotates about the rotational axis 14 while being withdrawn and moved radially of the center axle 20 and finally is released as shown in FIG. 7(*d*). In this manner, parting-line corresponding parts are formed only on the trailing edge face 21, the fillet face 22, and the leading edge face 23, which constitute outer peripheral sides of the full blade 3, in a space surrounded by the blades. That is, it is possible to obtain an impeller having no parting-line present in those locations in the space 10 shown in FIG. 2, which correspond to the hub surface 2 and the blade surfaces 5.

Figure 8:
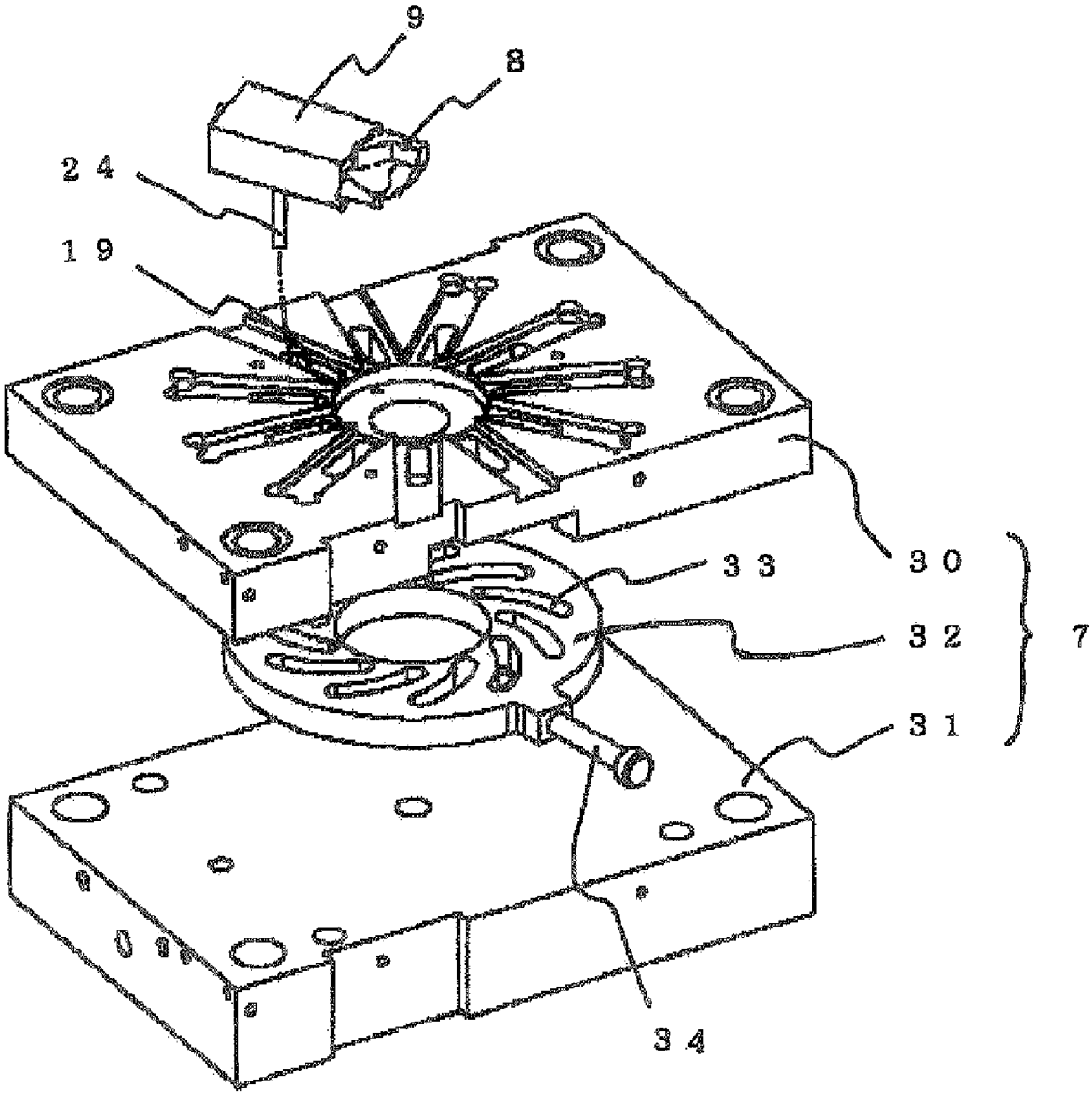
FIG. 8 is a schematic view showing an example of a construction, in which interlocking of a slide die is made possible.

In addition, a method of manually withdrawing and moving individual slide supports, preferably, a method, in which the slide supports 9 are integrated in an interlocking construction and the slide dies 8 are pulled out of an impeller at a time, can be adopted as measures for movement of the slide supports 9. For example, as shown in FIG. 8, a stationary die 7 is composed of a stationary die upper base 30, a stationary die lower base 31, and a cam plate 32 having cam grooves 33. Guide pins 24 of respective slide supports 9 are caused to extend through grooves 19 on the stationary die upper base 30 and the cam grooves 33 to be made integral. A drive lever 34 connecting thereto a drive device (not shown) such as motor, pressure cylinder, etc. is provided on the cam plate 32, and the respective slide supports 9 are integrated and interlocked by driving the cam plate 32 through the drive lever 34, whereby the respective slide dies 8 can be released. Further, it is preferable to automatically control moving operations of the slide supports.

As described above, an impeller for a supercharger, according to the invention, can be obtained by removing an unnecessary runner channel, sprue gate, flash, etc. from a molding 18 after casting and forming. Also, it is possible to perform surface treatment, such as plating, coating, etc., on an impeller thus obtained.

Thereby, it is possible to obtain an impeller for a supercharger, not having any parting-line corresponding part present on both a hub surface and blade surfaces in a space surrounded by blades.

According to the invention, while a molten metal may be manufactured by any method as far as an alloy as used is appropriate, it suffices in case of using, for example, an aluminum alloy and a magnesium alloy to melt the same with the use of a direct heating furnace such as gas type one, etc., an indirect heating furnace such as electric type one, etc., a melting crucible provided on a casting machine, or the like. It suffices to treat a molten metal in the atmosphere or in an atmosphere of inert gas. Subsequently, it suffices to supply a molten metal to a casting machine to cast the same in dies at a temperature suited to casting and in a molten or semi-molten state with flowability. At this time, it suffices that conditions of casting and forming, such as temperature, pressure, speed in casting, a cooling pattern after casting, etc. be selected so as to be conformed to a molten metal, a configuration of an impeller, a casting machine, etc. In addition, application of the vacuum casting method, the decompression casting method, or the pressurization casting method in casting a molten metal in dies is preferable since a favorable run quality is obtained even for a thin-walled portion of an impeller. Also, the thixomold casting method is preferable since a molding suffers less solidification defect such as shrinkage, crack, etc.

INDUSTRIAL APPLICABILITY

The impeller according to the invention is used in a supercharger, which makes use of exhaust gas from an internal combustion engine to feed a compressed air.

The invention claimed is:

1. An impeller for a supercharger, cast in dies and comprising:

a center axle;

a disk-shaped hub extending radially of the center axle; and a plurality of blades extending from the hub and consisting of full blades and splitter blades arranged alternately and in adjacent relationship, each of which blades has an aerodynamically curved surface, spaces defined by the blades forming undercuts extending radially of the center axle, wherein respective spaces defined by pairs of adjacent full blades comprise parting-line corresponding parts only on a trailing edge face, a fillet face, and a leading edge face, which form an outer periphery of the full blade, which parting-line corresponding parts have forms corresponding to parting-lines each formed among respective adjacent dies being brought into close contact with one another when casting.

2. The impeller for a supercharger according to claim 1, wherein the impeller for a supercharger is made of an aluminum alloy.

3. The impeller for a supercharger according to claim 1, wherein the impeller for a supercharger is made of a magnesium alloy.

4. The impeller for a supercharger according to claim 1, wherein the impeller for a supercharger is used at an intake side of the supercharger.

5. A method of manufacturing an impeller for a supercharger by die casting, which impeller comprises a disk-shaped hub extending radially of a center axle, a plurality of blades extending from the hub and consisting of full blades and splitter blades arranged alternately and in adjacent relationship, each of which blades has an aerodynamically curved surface, spaces defined by the blades forming undercuts extending radially of the center axle, wherein the process of die casting comprises the steps of:

forming a cavity by bringing a plurality of slide dies, which are arranged radially in relation to the axis of the impeller to be formed, into close contact with one another to form the impeller, each of the slide dies, having a hub cavity defining portion, blade cavity defining portions, and a bottomed groove portion in the form of a splitter blade thereby having a spatial configuration between a pair of adjacent full blades;

casting a molten metal into the cavity; and moving and releasing the slide dies radially of the formed center axle while rotating each of the slide dies around its rotational axis, whereby the impeller is obtained, which has a respective space defined by a pair of adjacent full blades comprises parting-line corresponding parts only on a trailing edge face, a fillet face, and a leading edge face, which form an outer periphery of the full blade, the parting-line corresponding parts having forms corresponding to parting-lines each formed among respective adjacent sliding dies brought into close contact with one another when casting.

6. The method of manufacturing an impeller for a supercharger according to claim 5, wherein a die device used in the process of casting in dies comprises a moving die capable of opening and closing movements in a direction along the axis of the impeller to be formed, a stationary die, the slide dies moving radially of the center axis, and slide supports, which supports the slide dies, wherein the slide supports are driven to enable interlocking of the slide dies.

7. The method of manufacturing an impeller for a supercharger according to claim 5, wherein a plurality of cores are bonded integrally to make the slide die.

8. The method of manufacturing an impeller for a supercharger according to claim 5, wherein a motional line, along which the slide die is released from a cast impeller, comprises a motional line at XY coordinates on a two-dimensional plane, to which the center axle of the impeller is perpendicular, and a motional line including a rotational component around the motional line at the XY coordinates.

9. The method of manufacturing an impeller for a supercharger according to claim 5, wherein an aluminum alloy is cast in the dies.

10. The method of manufacturing an impeller for a supercharger according to claim 5, wherein a magnesium alloy is cast in the dies.

11. An impeller for a supercharger, comprising a center axle;

a disk-shaped hub extending radially of the center axle;

a plurality of blades extending from the hub, consisting of full blades and splitter blades arranged alternately and in adjacent relationship to each other, each of said blades having an aerodynamically curved surface; and a plurality of spaces defined by pairs of adjacent full blades, and wherein parting-lines are only present on a trailing edge face, a fillet face, and a leading edge face, which form an outer periphery of each of the full blades, and parting-lines are not present on a surface of the hub between adjacent full blades.

12. A method of manufacturing an impeller for a supercharger, by die casting, wherein said impeller comprises a disk-shaped hub extending radially of a center axle, a plurality of blades extending from the hub and consisting of full blades and splitter blades arranged alternately and in adjacent relationship, each of said blades having an aerodynamically curved surface, and spaces defined by the blades forming undercuts extending radially of the center axle, comprising:

arranging a plurality of slide dies, each of said slide dies comprising a hub cavity defining portion, blade cavity defining portions, and a bottomed groove portion in the form of a splitter blade;

casting a molten metal; and moving and releasing said slide dies radially of the center axle while rotating said slide dies, wherein parting-lines are not present on a surface of the hub between adjacent full blades.

13. An impeller for a supercharger, cast in dies and comprising:

a center axle:

a disk-shaped hub extending radially of the center axle; and a plurality of blades extending from the hub and consisting of full blades and splitter blades arranged alternately and in adjacent relationship, each of which blades has an aerodynamically curved surface, spaces defined by the blades forming undercuts extending radially of the center axle, wherein respective spaces defined by pairs of adjacent full blades comprise parting-line corresponding parts only on a trailing edge face, a fillet face, and a leading edge face which form an outer periphery of the full blade, wherein parting-line corresponding parts have forms corresponding to parting-lines each formed among respective adjacent dies brought into close contact with one another when casting, the dies being slide dies each having a hub cavity defining portion, blade cavity defining portions, and a bottomed groove portion.

* * * * *